US011485102B2

(12) United States Patent
Fanciullacci et al.

(10) Patent No.: US 11,485,102 B2
(45) Date of Patent: Nov. 1, 2022

(54) MACHINE AND METHOD FOR PROCESSING A BOX-LIKE ELEMENT OR SIMILAR

(71) Applicant: Bartoli Packaging S.r.l., Monsummano Terme (IT)

(72) Inventors: Roberto Fanciullacci, Monsummano Terme (IT); Alessandro Bovani, Florence (IT)

(73) Assignee: BARTOLI PACKAGING S.R.L., Monsummano Terme (IT)

( * ) Notice: Subject to any disclaimer, the term of this patent is extended or adjusted under 35 U.S.C. 154(b) by 262 days.

(21) Appl. No.: 16/971,624

(22) PCT Filed: Feb. 22, 2019

(86) PCT No.: PCT/IT2019/050037
§ 371 (c)(1),
(2) Date: Aug. 20, 2020

(87) PCT Pub. No.: WO2019/162978
PCT Pub. Date: Aug. 29, 2019

(65) Prior Publication Data

US 2021/0101355 A1 Apr. 8, 2021

(30) Foreign Application Priority Data

Feb. 23, 2018 (IT) ..... 102018000002993

(51) Int. Cl.
*B31B 50/81* (2017.01)
*B31B 105/00* (2017.01)
(Continued)

(52) U.S. Cl.
CPC ..... *B31B 50/811* (2017.08); *B31B 50/8125* (2017.08); *B31B 50/87* (2017.08);
(Continued)

(58) Field of Classification Search
CPC ..... B31B 50/8125; B31B 2105/00; B31B 2110/35; B31B 2120/50; B31B 50/87;
(Continued)

(56) References Cited

U.S. PATENT DOCUMENTS 2,387,329 A * 10/1945 Jacobs ..... B65D 5/46016 229/117.26
3,808,957 A * 5/1974 Hosoya ..... B31B 50/87 53/134.1

(Continued)

OTHER PUBLICATIONS

Int'l Search Report and Written Opinion dated Jun. 13, 2019 in Int'l Application No. PCT/IT2019/050037.

*Primary Examiner* — Andrew M Tecco
*Assistant Examiner* — Jacob A Smith
(74) *Attorney, Agent, or Firm* — Panitch Schwarze Belisario & Nadel LLP

(57) ABSTRACT

A machine to work a box-like element or similar includes a cutting unit to cut a strip-like element on a corresponding lying plane in a first substantially plane configuration; a loading unit with a thrust blade translatable in a first direction; a folding and insertion unit having a housing seating of the strip-like element that is directed substantially orthogonally to said lying plane, so that after translation of the thrust blade in said first direction the strip-like element is introduced into said housing seating, assumes a "U" shape and has flaps and a connection part; said folding and insertion unit being translatable in a second direction to at least partly insert said flaps in a slit in the box-like element; and an attachment unit of part of said flaps inside said box-like element on which the slit is made, so that the connection part protrudes from the box-like element.

10 Claims, 8 Drawing Sheets

(51) Int. Cl.

| | |
|---|---|
| *B31B 110/35* | (2017.01) |
| *B31B 120/50* | (2017.01) |
| *B31B 50/86* | (2017.01) |
| *B65D 5/46* | (2006.01) |

(52) U.S. Cl.
CPC ..... *B31B 2105/00* (2017.08); *B31B 2110/35* (2017.08); *B31B 2120/50* (2017.08); *B65D 5/46016* (2013.01)

(58) Field of Classification Search
CPC ..... B31B 50/86; B31D 1/06; B65D 5/46032; B65D 5/46016; B65D 5/46024; B65D 5/46088
USPC ..... 229/177.16; 493/226
See application file for complete search history.

(56) References Cited

U.S. PATENT DOCUMENTS

2015/0306835 A1* 10/2015 Dunivan ..... B65B 7/20 493/73
2016/0031603 A1* 2/2016 Schettle ..... B65D 25/22 220/660

* cited by examiner

MACHINE AND METHOD FOR PROCESSING A BOX-LIKE ELEMENT OR SIMILAR

CROSS-REFERENCE TO RELATED APPLICATIONS

This application is a Section 371 of International Application No. PCT/IT2019/050037, filed Feb. 22, 2019, which was published in the English language on Aug. 29, 2019 under International Publication No. WO 2019/162978 A1, which claims priority under 35 U.S.C. § 119 to Italian Patent Application No. 102018000002993, filed on Feb. 23, 2018 the disclosures of all of which are incorporated herein by reference.

FIELD OF THE INVENTION

The present invention concerns a machine and a method to work a box-like element or suchlike, for example a box.

The present machine and the present method concern in particular the application, in a precise and stable manner, of at least one strip-like element on a box-like element, or suchlike, so that the strip-like element can be used, as a non-restrictive example, as a handle, grip or other.

BACKGROUND OF THE INVENTION

It is known that different types of box-like elements, or boxes, exist, to which it is desirable to apply at least one strip-like element to make a grip, a handle or other. The strip-like element can be, for example, a strip made of a flexible material, for example a fabric, such as cotton or suchlike.

A box-like element of a known type, which is referred to here as a non-restrictive example, is the so-called covered box.

The covered box normally consists of a sheet of cardboard, or suchlike, of suitable sizes depending on the object or objects it has to contain, and a sheet of paper, suitably shaped, which covers the box-like element externally and sometimes also covers it internally. If the box-like body is covered both internally and externally, it is normally called a coupled cardboard box.

To make a covered box, with at least the external covering of the sheet of paper, commercial machines are used which allow to obtain a raw box from a cardboard blank, and then a box with a sheet of paper applied at least on the outside. The last step of this wrapping can be finalized in a so-called covering machine, the purpose of which is to cover the sides of the raw box and fold back the excess paper toward the inside of the box.

If it becomes necessary or desirable to apply a strip-like element to the box-like element, for example the covered box, which is intended to act as a grip, handle or other, it is necessary to cut to size the strip-like element substantially manually from a corresponding reel of strip, to fold and insert it, always manually, inside a slit made on the wall of the box-like element. The strip-like element will then be attached in a sufficiently stable manner inside the box-like element, so that it cannot be easily detached or removed and can therefore act as a grip, handle or other.

Naturally, these manual operations of cutting, folding, inserting and attaching the strip-like element to the box-like element entail considerable loss of time and results that are not very precise, not very stable and lacking the required uniformity.

We must immediately point out that this problem of applying a strip-like element on a box-like element is felt both in the production of covered boxes and also in the production of normal boxes without coverings, or boxes formed solely of a sheet of cardboard suitably shaped to form a box-like body.

Other limitations and disadvantages of conventional solutions and technologies will be clear to a person of skill after reading the remaining part of the present description with reference to the drawings and the description of the embodiments that follow, although it is clear that the description of the state of the art connected to the present description must not be considered an admission that what is described here is already known from the state of the prior art.

There is therefore the need to perfect a machine and a method to work a box-like element which can overcome at least one of the disadvantages of the state of the art.

One purpose of the present invention is to produce a machine to work a box-like element, or suchlike, which allows to automatically apply a strip-like element to a box-like element in a stable and precise manner, so that the strip-like element can be used as a grip, handle or other.

Another purpose of the present invention is to produce a machine to work a box-like element, or suchlike, which can be used effectively for any box-like element, therefore a box without covering, a covered box, a coupled cardboard box, or other.

The present invention also concerns a method to work a box-like element which is quick, efficient and automated.

The Applicant has devised, tested and embodied the present invention to overcome the shortcomings of the state of the art and to obtain these and other purposes and advantages.

SUMMARY OF THE INVENTION

The present invention is set forth and characterized in the independent claims, while the dependent claims describe other characteristics of the invention or variants to the main inventive idea.

In accordance with the above purposes, a first purpose of the invention is a machine to work a box-like element, or suchlike, comprising at least a work apparatus provided with: at least a cutting unit to cut at least a strip-like element positioned on a corresponding lying plane in a first substantially plane configuration; at least a loading unit provided with at least a thrust blade translatable in a first direction; at least a folding and insertion unit provided with a housing seating of the strip-like element, the housing seating is directed substantially in an orthogonal direction with respect to the lying plane of the strip-like element in the first substantially plane configuration, so that following the translation of the thrust blade in the first direction the strip-like element is introduced into the housing seating, assumes a substantial "U" shape and has at least a pair of flaps and at least a connection part, the folding and insertion unit is translatable in a second direction toward the box-like element so as to at least partly insert the pair of flaps in a slit made in the box-like element; and at least an attachment unit of part of the flaps of the strip-like element inside the box-like element on which the slit is made, so that at least the connection part protrudes from the box-like element.

Advantageously, by means of the present work machine, it is possible to perform the cutting, folding, insertion and attachment of a strip-like element to a box-like element, so that the strip-like element is substantially U-shaped and can be used as a grip, handle or other.

The first direction of translation of the loading unit can be substantially orthogonal to the lying plane of the strip-like element and substantially aligned with the housing seating.

The housing seating can have a thickness equal substantially to the sum of the thickness of the flaps of the strip-like element and of the thrust blade.

The housing seating can be defined by at least one pair of small blades between which the strip-like element is inserted.

The housing seating can comprise at least one abutment element for the connection part.

The attachment unit can comprise at least one arm configured to remove at least one adhesive label from a strip of adhesive labels and apply it to the flaps of the strip-like element.

The arm can comprise at least a mouth configured to suck in or blow air and suitable to retain the adhesive label or allow to send a stream of air toward the flaps of the strip-like element so that they suitably spread apart, the adhesive label can be provided with a through hole for the passage of the stream of air from the arm.

The work machine can comprise a gluing apparatus located downstream of the work apparatus and configured to apply at least one sheet of paper, cardboard or other material, to the inside of a wall of the box-like element where the flaps of the strip-like element are attached.

The work machine can comprise a rotatable table, the rotatable table can be configured to rotate intermittently and take the box-like element from a loading apparatus to at least the work apparatus and then to at least an extraction apparatus of the box-like element.

The invention also concerns a method to work a box-like element, or suchlike, by means of a work machine according to any of the previous claims, comprising: cutting to size a strip-like element; folding the strip-like element cut to size so as to obtain therefrom a substantially U-shaped conformation; inserting two flaps of the strip-like element folded substantially U-shaped inside a slit made on a box-like element, so that at least part of the two flaps is protruding inside the box-like element and a connection part of the folded strip-like element is protruding from the slit; attaching the protruding flaps inside the box-like element.

These and other aspects, characteristics and advantages of the present disclosure will be better understood with reference to the following description, drawings and attached claims. The drawings, which are integrated and form part of the present description, show some embodiments of the present invention, and together with the description, are intended to describe the principles of the disclosure.

The various aspects and characteristics described in the present description can be applied individually where possible. These individual aspects, for example aspects and characteristics described in the description or in the attached dependent claims, can be the object of divisional applications.

It is understood that any aspect or characteristic that is discovered, during the patenting process, to be already known, shall not be claimed and shall be the object of a disclaimer.

BRIEF DESCRIPTION OF THE DRAWINGS

These and other characteristics of the present invention will become apparent from the following description of some embodiments, given as a non-restrictive example with reference to the attached drawings wherein:

FIGS. 11 to 19 are schematic lateral views showing cutting, folding, inserting and attachment steps of the strip-like element to a wall of a box-like element, in which

To facilitate comprehension, the same reference numbers have been used, where possible, to identify identical common elements in the drawings. It is understood that elements and characteristics of one embodiment can conveniently be incorporated into other embodiments without further clarifications.

DETAILED DESCRIPTION OF SOME EMBODIMENTS

We will now refer in detail to the various embodiments of the invention, of which one or more examples are shown in the attached drawings. Each example is supplied by way of illustration of the invention and shall not be understood as a limitation thereof. For example, the characteristics shown or described insomuch as they are part of one embodiment can be adopted on, or in association with, other embodiments to produce another embodiment. It is understood that the present invention shall include all such modifications and variants.

Before describing these embodiments, we must also clarify that the present description is not limited in its application to details of the construction and disposition of the components as described in the following description using the attached drawings. The present description can provide other embodiments and can be obtained or executed in various other ways. We must also clarify that the phraseology and terminology used here is for the purposes of description only, and cannot be considered as limitative.

Figure 1:
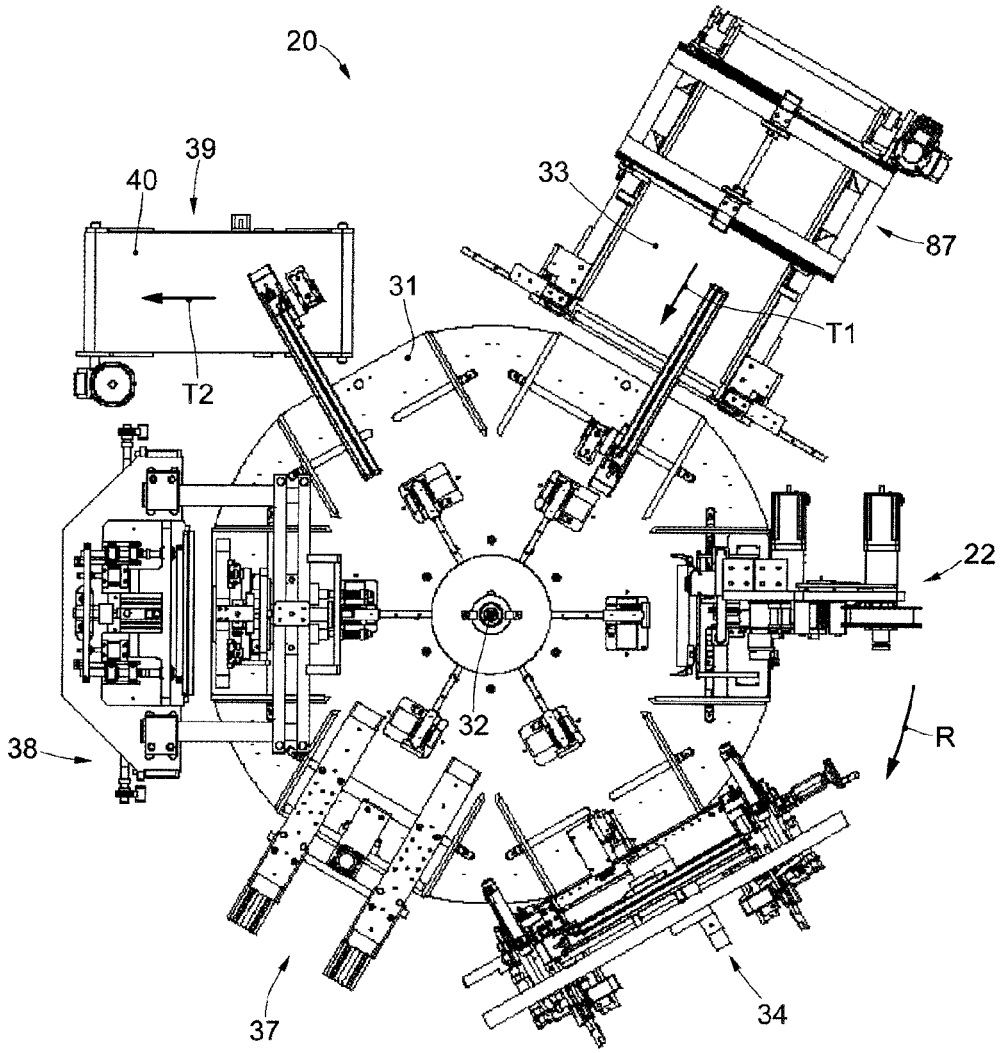
FIG. 1 is a plan view of a work machine for a box-like element or suchlike according to the invention.

With reference to the attached drawings and with particular reference to FIG. 1 thereof, a work machine 20 according to the invention comprises at least one work apparatus 22, suitable to receive at least one box-like element 23, 24.

Figure 2:
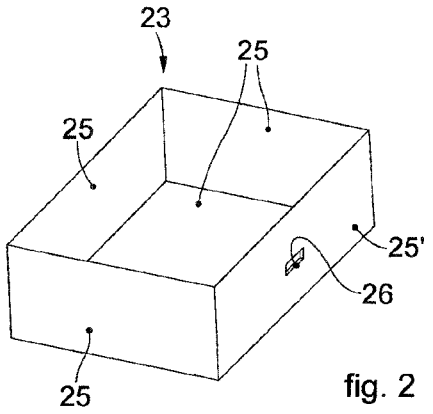
FIG. 2 is a three-dimensional view of a first box-like element which can be worked by the present work machine.
Figure 3:
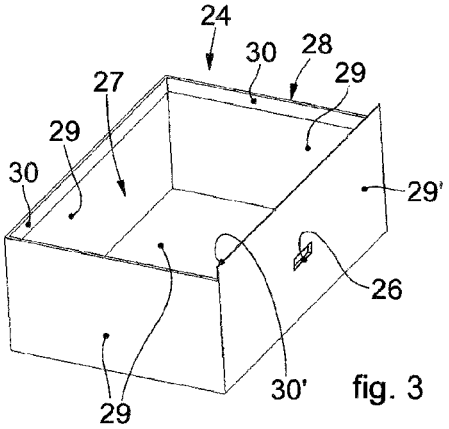
FIG. 3 is a three-dimensional view of a second box-like element which can be worked by the present work machine.

The box-like element 23, 24 comes from a loading apparatus 87 located upstream of the work apparatus 22 and which will substantially receive the box-like element 23, 24 as shown in FIG. 2 or FIG. 3, that is, already provided with a slit 26 through which the strip-like element 35 will have to be inserted.

The box-like element 23, see FIG. 2, can be a covered box, a coupled cardboard box, and also a box without covering. The box-like element 23 is provided with a series of walls 25 and the slit 26 is made on at least one of these walls, for example the wall 25'.

The box-like element 24, see FIG. 3, is in this case a covered box, comprising an internal box-like body 27 and at least one external sheet of paper 28, which is normally glued onto the internal box-shaped body 27.

The box-like element 24 is also provided with a series of walls 29, in at least one of which, for example the wall 29', the slit 26 is made.

A strip-like element 35 is applied on the box-like elements 23, or 24, to be used as a grip, handle or other. For example, it can be assumed that the strip-like element 35 is used as a handle, if the box-like element 23, or 24, is used as a containing drawer to be housed in another box-like container.

The slit 26 can have, for example, a square or rectangular shape, but could also be of another shape.

In the box-like element 24 of FIG. 3, a flap 30' of the sheet of paper 28 which covers the box-shaped body 27 is left protruding from the edge of the wall 29' where the slit 26 is made. The other flaps 30 of the sheet of paper 28 are folded and folded back on the corresponding walls 29.

The work machine 20 can be provided, for example, with a rotatable table 31, centrally connectable to a rotation shaft 32, which will be rotated at least in direction R by suitable drive means. The drive means can be, for example, a stepper motor, or suchlike, by means of which the rotatable table 31 can be rotated intermittently.

The box-like element 23, 24 therefore arrives on the rotatable table 31 from the loading apparatus 87, provided for example with a conveyor belt 33 mobile in the direction T1.

By means of a first rotation in direction R of the rotatable table 31, the box-like element 23, 24 is taken into correspondence with the work apparatus 22.

By means of successive rotations, in particular stepwise rotations in direction R, the rotatable table 31 can take the box-like element 23, 24 being worked toward other successive apparatuses of the work machine 20.

Downstream of the work apparatus 22, which will be described in detail below, a gluing apparatus 34 is provided, configured to apply a sheet 36 of cardboard, or other material, see FIG. 6, inside the wall 25' or 29' on which the strip-like element 35 is applied.

Downstream of the gluing apparatus 34 a pressing apparatus 37 is provided, to press the sheet of cardboard 36 inside the wall 25' or 29'.

Downstream of the pressing apparatus 37 a folding apparatus 38 is shown, configured to fold and tuck the flap 30' of the sheet of paper 28 toward the inside of the box-like body 27, if the box-like element 24 of FIG. 3 is used from the start.

Downstream of the folding apparatus 38, an extraction apparatus 39 is provided, equipped for example with a conveyor belt 40 translating in direction T2 and suitable to allow the extraction of the box-like elements 23, 24 provided with a strip-like element 35.

According to the number of apparatuses of the work machine 20, it is possible to predict the entity of each rotation to take the box-like element 23 or 24 from one apparatus to the next of the work machine 20. In this example, six work apparatuses have been provided, so each rotation of the rotatable table 31 can be about 60°.

Naturally, the work machine 20 could also be in-line, that is provide an in-line transfer of the box-like element 23 or 24, being worked between two work apparatuses disposed in succession.

In the work machine 20, the work apparatus 22 is of primary importance, which substantially automatically performs operations of cutting, folding, inserting and at least temporarily attaching the strip-like element 35 to the box-like element 23, 24.

Figure 4:
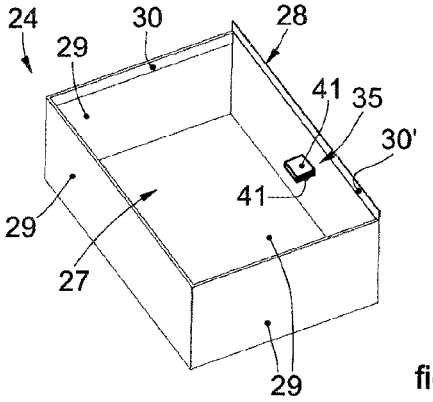
FIG. 4 is a view of the box-like element of FIG. 3 provided with a strip-like element.
Figure 5:
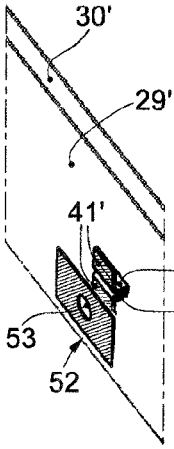
FIG. 5 is a view of the box-like element of FIG. 4 to which a label can be applied to fix in position, at least temporarily, the flaps of the strip-like element.
Figure 7:
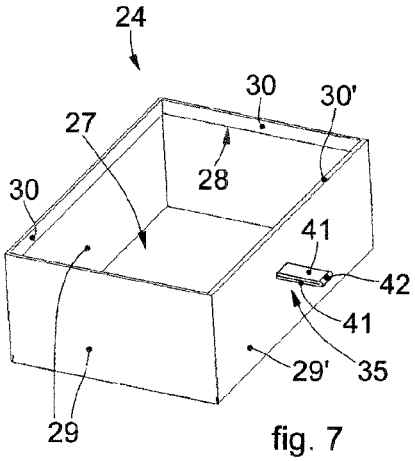
FIG. 7 is another three-dimensional view of the box-like element of FIG. 4 with a substantially U-shaped strip-like element.

The strip-like element 35, see FIGS. 4, 5 and 7 for example, is substantially U-shaped and comprises a pair of flaps 41 which are at least partly inserted inside the box-like element 23, 24, through the slit 26.

The strip-like element 35 also comprises a connection part 42 which is positioned outside the box-like element 23, 24 and which can be used as a grip, handle or other.

The connection part 42 is a portion closed in a ring, arc or suchlike.

Figure 8:
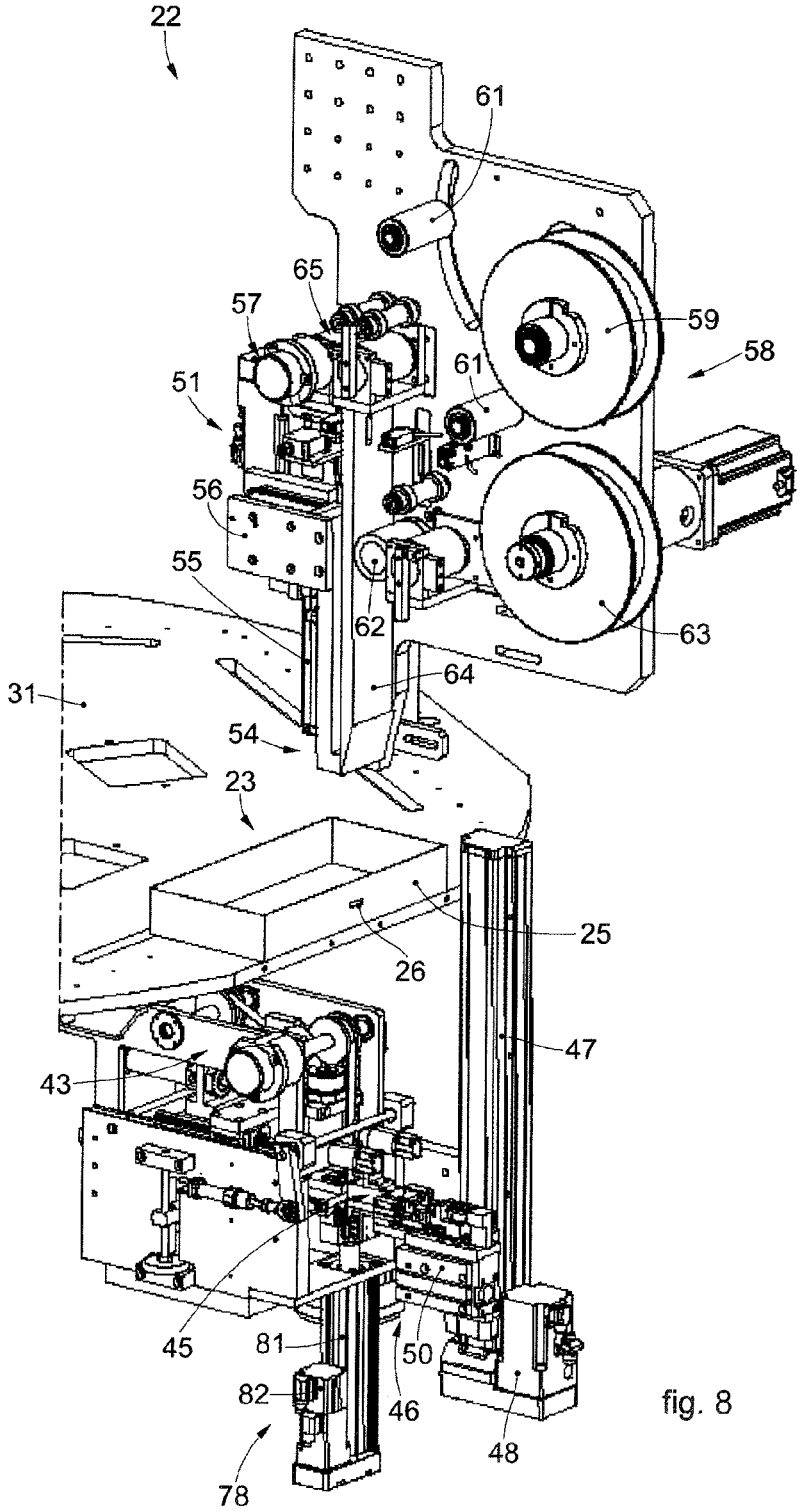
FIG. 8 is a three-dimensional view of a work apparatus according to the invention.
Figure 9:
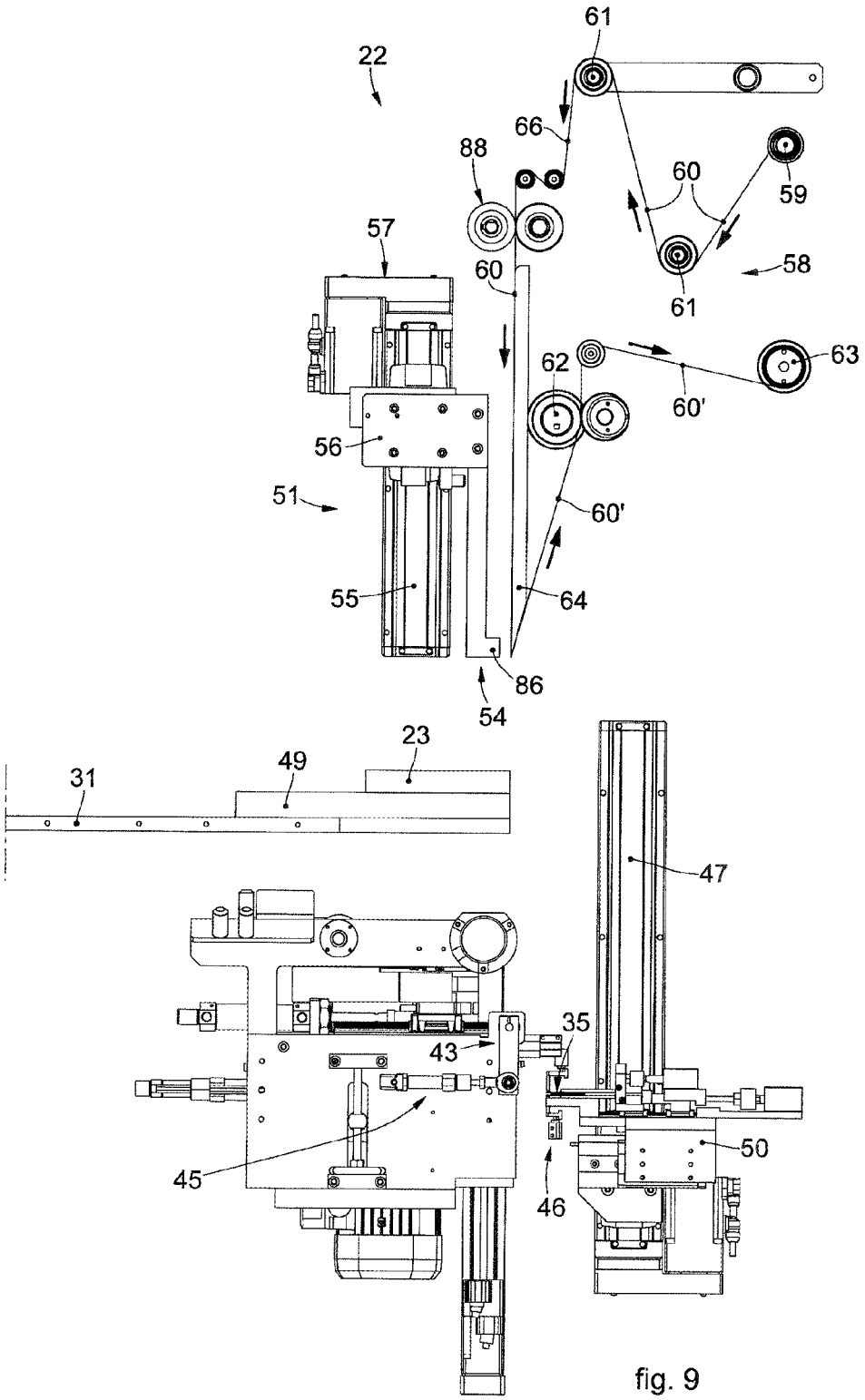
FIG. 9 is a schematic lateral view of the work apparatus of FIG. 8.
Figure 10:
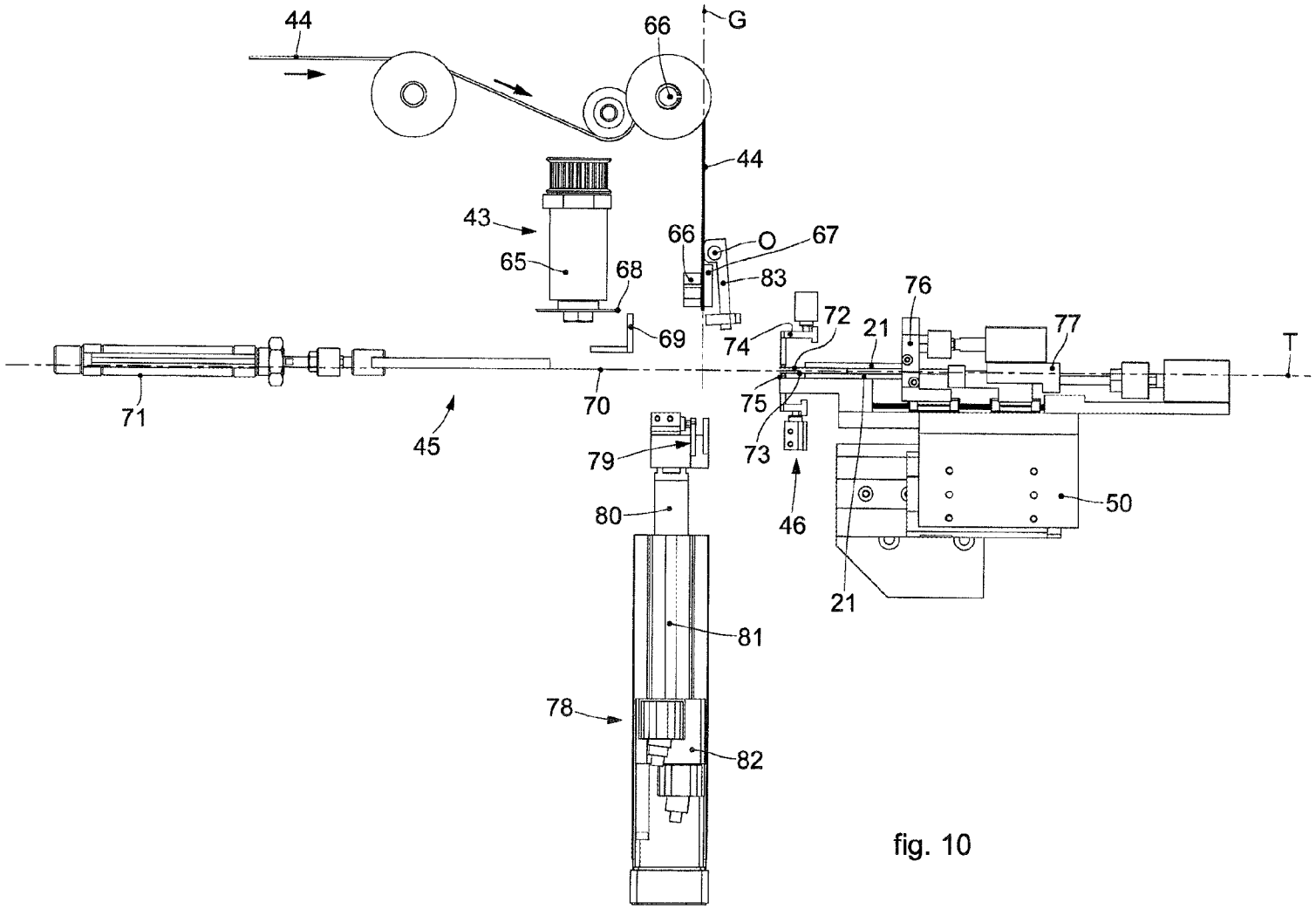
FIG. 10 is a schematic lateral view of a part of the work apparatus of FIG. 8 and FIG. 9.
Figure 11:
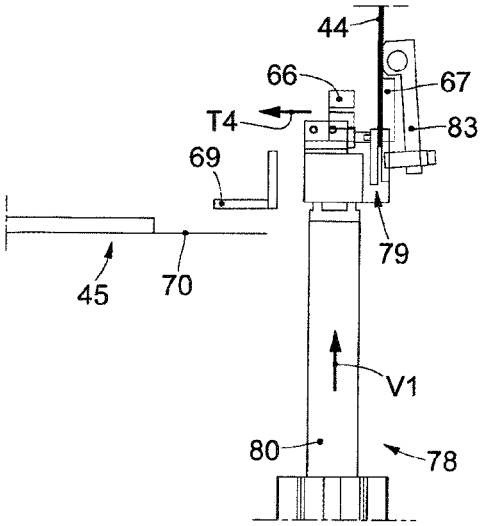

The work apparatus 22, see FIG. 8 and FIG. 9, comprises a cutting unit 43 to cut a strip 44, see also FIG. 10, so as to obtain the strip-like element 35.

The cutting unit 43 is positioned in proximity to a loading unit 45, suitable to load the strip-like element 35 cut to size inside a folding and insertion unit 46, suitable to fold the strip-like element 35 into a substantial U-shape, cooperating with the loading unit 45, and to insert it into the slit 26 of the box-like element, for example the box-like element 23 or 24.

The folding and insertion unit 46 is mobile along a guide 47, for example by means of suitable drive means 48 which drive a slider 50, so as to take the strip-like element 35 up to the height of the rotatable table 31, in particular to the height of the slit 26 of the box-like element 23.

The box-like element 23 or 24, can be maintained in position on the rotatable table 31 by means of suitable guides 49.

The work apparatus 22 also comprises an attachment unit 51, configured to apply an adhesive label 52 on the parts of the flaps 41 of the strip-like element 35 protruding inside the box-like element 23 or 24.

The adhesive label 52, see FIG. 5 in particular, is of a size suitable to engage the folded portions 41' of the flaps 41 of the strip-like element.

The portions 41' go to lie on the internal side of the wall 25' or 29' on which the strip-like element 35 is applied.

The adhesive label 52 is also provided, for example in a central position, with a through hole 53, in particular to allow a stream of air to pass through the adhesive label 52 during the application steps of the strip-like element 35.

The attachment unit 51 comprises a positioning arm 54 of each adhesive label 52 which is mobile along a guide 55, for example in a vertical direction.

The arm 54 can, for example, be provided with a mouth 86, suitable to suck in air and therefore retain an adhesive label 52. As we shall see, the exit of a stream of air is also possible from the mouth 86.

The arm 54 can be positioned on a slider 56 slidable along the guide 55 by means of corresponding drive means 57, for example an electric, pneumatic, oil dynamic motor or suchlike.

The adhesive labels 52 are removed from a corresponding supply assembly 58, provided with a reel 59 around which a strip 60 with adhesive labels 52 is wound.

The strip 60 with adhesive labels 52 is unwound by suitable drive means 62 and possible return rolls 61, for example a stepper motor disposed for example downstream of the arm 54, so as to take the adhesive labels 52 into correspondence with the mouth 86 of the arm 54.

Upstream of the positioning arm 54 of the adhesive label 52 a guide 64 can be provided along which the strip 60 with adhesive labels 52 slides.

Upstream of the guide 64 a braking device 88 can be provided, suitable to determine the correct sliding speed of the strip 60.

Downstream of the drive means 62, a collection device 63 can be provided, suitable to wrap the strip 60' without adhesive labels.

A strip 44 is used to form the strip-like element 35, which can be unwound from a reel, not shown, by suitable drive means 62, for example a stepper motor, see FIG. 10.

The strip 44 can be, for example, a strip of fabric, such as cotton or suchlike, or other flexible material suitable to be applied to a box-like element 23, 24 and in particular to the applications for which the box-like element 23, 24 is designed.

The strip 44 is located in proximity to the cutting unit 43 preferably on a substantially vertical lying plane G.

The strip 44 is held in position by a pair of vices 66 and 67.

It is possible to provide another vice 83, suitable to rotate around an axis O around which it is pivoted. In FIG. 10 the vice 83 is deactivated.

The cutting unit 43, again see FIG. 10, substantially comprises a mandrel 65 provided with a cutting element 68, for example a blade or suchlike, and can be suitable to be translated away from or toward the strip 44.

Figure 13:
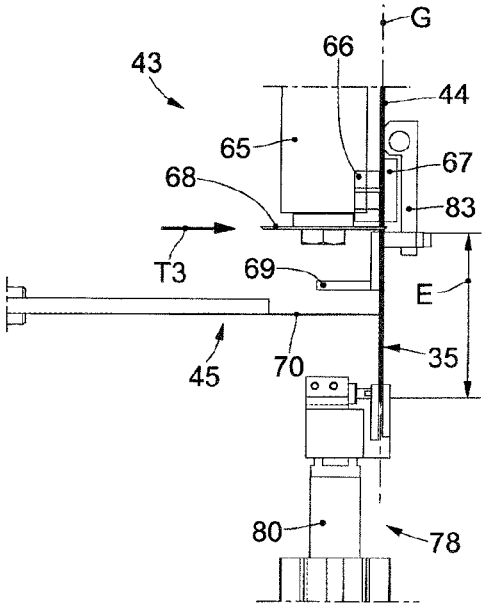

Preferably, the cutting unit 43 can be translated in a direction T3, see FIG. 13, perpendicular to the lying plane G of the strip 44.

The cutting unit 43 is also provided with an abutment member 69 suitable to cooperate with the other vice 83.

The loading unit 45 comprises a thrust blade 70 which can be translated in one direction or in the other away from or toward the strip 44, for example in direction T, so as to engage, substantially orthogonally, the strip-like element 35 located in a substantially flat or lying position on the lying plane G.

The thrust blade 70 is supported by a slider 71, suitable to slide, by means of corresponding actuator means, so as to move the thrust blade 70 closer to or away from the strip 44.

The folding and insertion unit 46 is provided on the opposite side of the loading unit 45 with respect to the strip 44.

Figure 14:
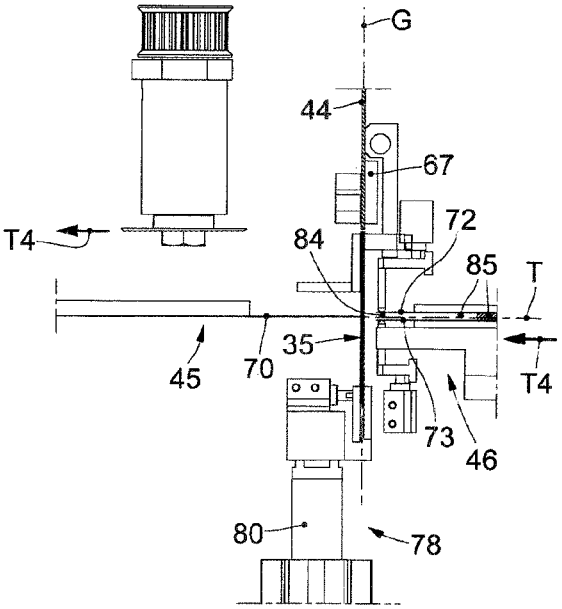
Figure 15:
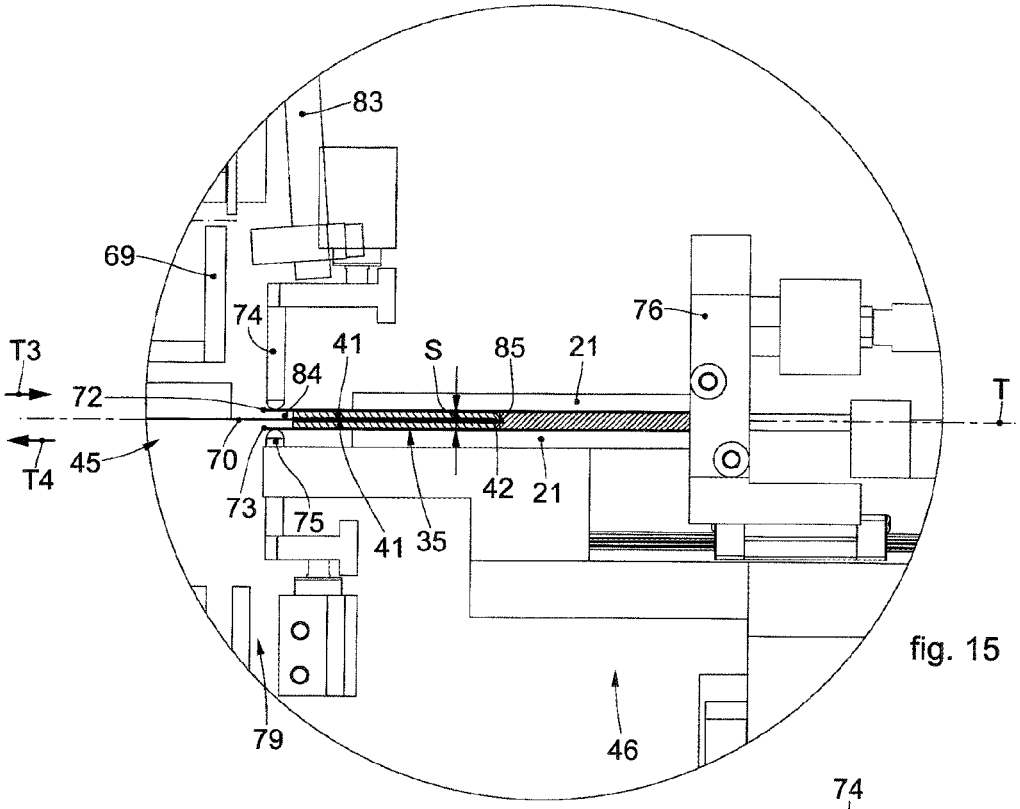

The folding and insertion unit 46 is provided with a housing seating 84 of the strip-like element 35, see FIG. 14 and FIG. 15.

The thickness S of the housing seating 84 is substantially equal to the sum of the thicknesses of the flaps 41 and of the thrust blade 70.

In particular, the housing seating 84 is defined by the space made between a pair of small blades 72 and 73.

The strip-like element 35 is inserted by means of the thrust blade 70 in the housing seating 84, and in particular between the pair of small blades 72 and 73.

An abutment element 85 can be provided on the bottom of the housing seating 84, for example to determine the correct position of the strip-like element 35 and the correct protrusion length of the flaps 41 inside the wall 25', 29' of the box-like element 23, 24.

The small blades 72 and 73 are normally parallel and can be reciprocally brought closer by means of corresponding actuators 74 and 75 which can reduce their reciprocal distance.

The small blades 72 and 73 can be made, for example, of metal material and are preferably suitable to elastically return to a parallel position, once the action of the actuators 74 and 75 has ceased.

The small blades 72 and 73 can be positioned on a first slider 76 translating in direction T moving away from or toward the strip 44.

The small blades 72 and 73 are also disposed between two supports 21, so that they can translate in a suitable way in one direction or the other, for example in direction T. The slider 76 will be driven by suitable actuators and is integral to the supports 21 of the small blades 72 and 73.

The folding and insertion unit 46, as well as being vertically translated by the slider 50, can be translated away from or toward the strip 44, preferably in the direction T, by means of the slider 77, driven by suitable actuators.

In FIG. 10, a removal unit 78 is also shown between the loading unit 45 and the folding and insertion unit 46, provided with a gripper 79 suitable to grip the strip 44.

The gripper 79 can be lowered or raised toward the strip 44 by means of an arm 80 slidable in a suitable guide 81 by means of corresponding drive means 82.

In particular, the gripper 79 can translate the strip 44 along the lying plane G.

We will now look at a possible sequence to cut, fold, insert and at least temporarily attach a strip-like element 35, with reference in particular to the sequence shown in FIGS. 11 to 19.

The removal unit 78 is driven so that the arm 80 translates in direction V1 and the gripper 79 grips a portion of the strip 44.

When the gripper 79 has gripped the strip 44, it is possible to move the vice 66 away, translating it for example in direction T4.

Figure 12:
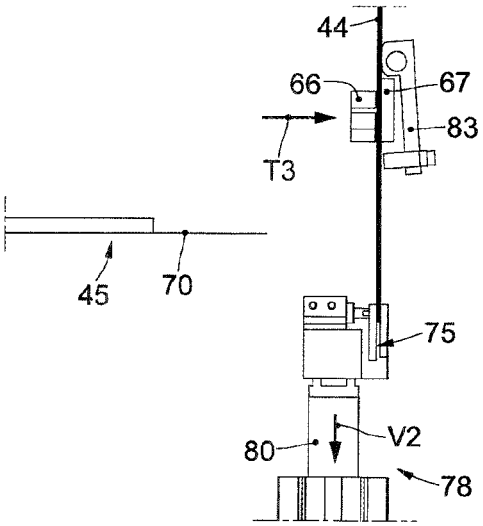

The removal unit 78 lowers the strip 44 gripped by the gripper 79 by translating the arm 80 in direction V2, see FIG. 12.

Once the translation in direction V2 has been completed, the vice 66 can be closed so that the strip is held between the vices 66 and 67 and the gripper 79 of the removal unit 78.

At this point, the cutting unit 43 is translated in direction T3 so that the cutting element 68 cuts the strip 44 upstream of the abutment member 69, see FIG. 13.

In order to make the cut and thus obtain a strip-like element 35 having a desired length or extension E, the vice 83 is closed on the abutment member 69, so as to retain a part of the strip-like element 35. The opposite part of the strip-like element 35 is retained by the gripper 79.

In FIG. 13 or FIG. 14, the strip-like element 35 is in a substantially flat configuration and is positioned on the lying plane G.

The loading unit 45 will also be translated in direction T3 toward the strip-like element 35, until the thrust blade 70 comes into contact with the strip-like element 35.

The mandrel 65 of the cutting unit 43 can be translated in direction T4 away from the strip 44, while the abutment member 69 is left in position so that it retains one end of the strip-like element 35, cooperating with the vice 83. The other end of the strip-like element 35 is retained by the gripper 79, see FIG. 14.

The folding and insertion unit 46 is also translated, for example in direction T4, opposite to direction T3, so that the small blades 72 and 73 are brought in proximity to the strip-like element 35.

The thrust blade 70 is translated in direction T3 so that it takes the flaps 41 of the strip-like element 35 inside the housing seating 84.

The thrust blade 70, therefore, substantially, allows to fold onto itself the strip-like element 35 into two flaps 41, preferably parallel.

The thrust blade 70 is preferably positioned in the middle of the extension E or length of the strip-like element 35, so that the two flaps 41 are of the same extension or length, therefore each of the flaps 41 can have an extension equal to about half of E.

During this operation of inserting the thrust blade 70 into the housing seating 84, the vice 83 is moved away from the abutment member 69 and the gripper 79 is opened, so that the strip-like element 35 is free to be engaged by the thrust blade.

The situation can therefore be as shown in FIG. 15, with the strip-like element 35 substantially U-shaped and inserted in the housing seating 84 between the small blades 72 and 73.

In the position of FIG. 15, the thrust blade 70 has completed its travel inside the housing seating 84, made in particular between the small blades 72 and 73.

The flaps 41 of the strip-like element 35, in the position of FIG. 15, are substantially parallel to the transverse direction T and therefore, perpendicular to the lying plane G on which, at the beginning of the cycle, the strip-like element 35 lay.

In the formation of the U-shaped configuration of the strip-like element 35, therefore, the flaps 41 are rotated substantially by 90° with respect to the substantially flat initial configuration of the strip-like element 35 on the lying plane G.

The thrust blade 70 is then retracted, for example in direction T4, while the folding and insertion unit 46 can be translated, for example in direction V1, to be taken level with the rotatable table 31 and therefore with the box-like element 23.

Figure 16A:
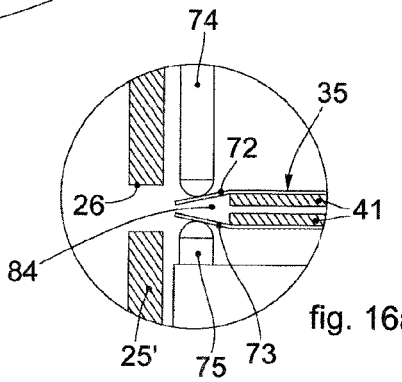
FIG. 16*a* is an enlargement of the area circled in FIG. 16.
Figure 16:
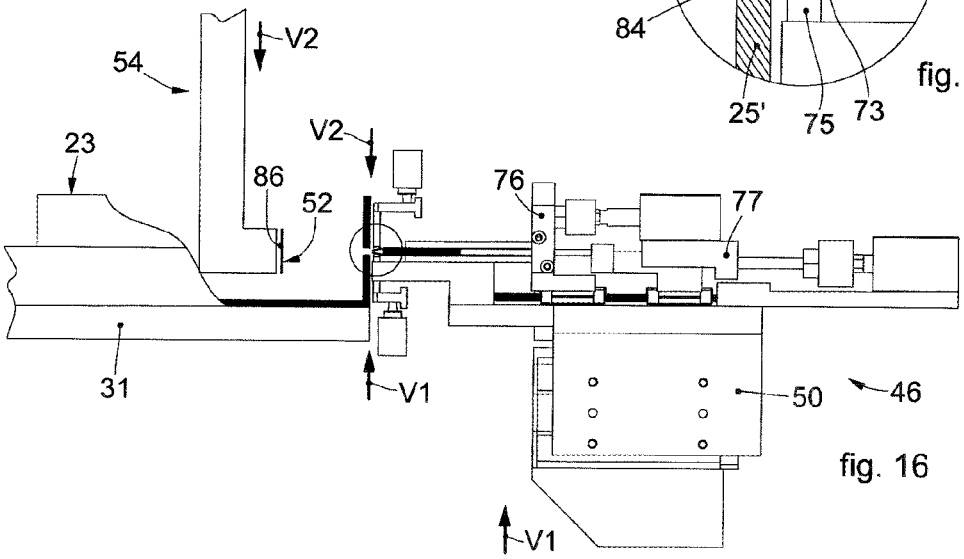

The arm 54 provided with the mouth 86 has been taken into proximity to the strip 60 so as to remove an adhesive label 52 by suction, then moved away from the strip 60 again and lowered in direction V2 into the box-like element 23, or 24, see FIG. 16, in particular in front of the slit 26.

Figure 17:
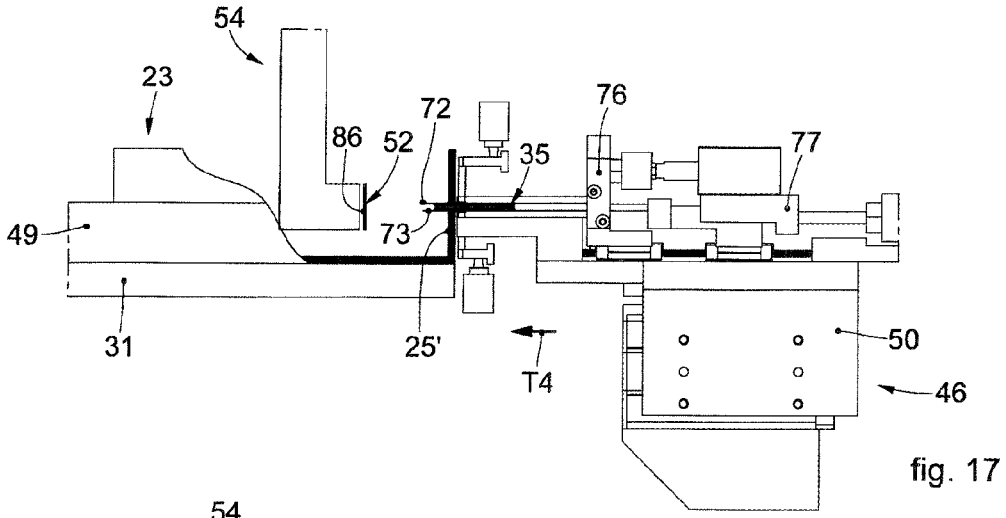

To insert the flaps 41 of the strip-like element 35 inside the slit 26 of the box-like element 23 or 24, the folding and insertion unit 46 has to be translated in direction T4, compare FIG. 16 and FIG. 17.

In particular, the small blades 72 and 73 with the substantially U-shaped strip-like element 35 inside are translated in direction T4 so that they are inserted inside the slit 26.

To facilitate this operation, it is possible, see FIG. 16, that the actuators 74 and 75 bring the ends of the small blades 72 and 73 closer, and then release them once the small blades 72 and 73 are engaged in the slits 26.

Figure 18:
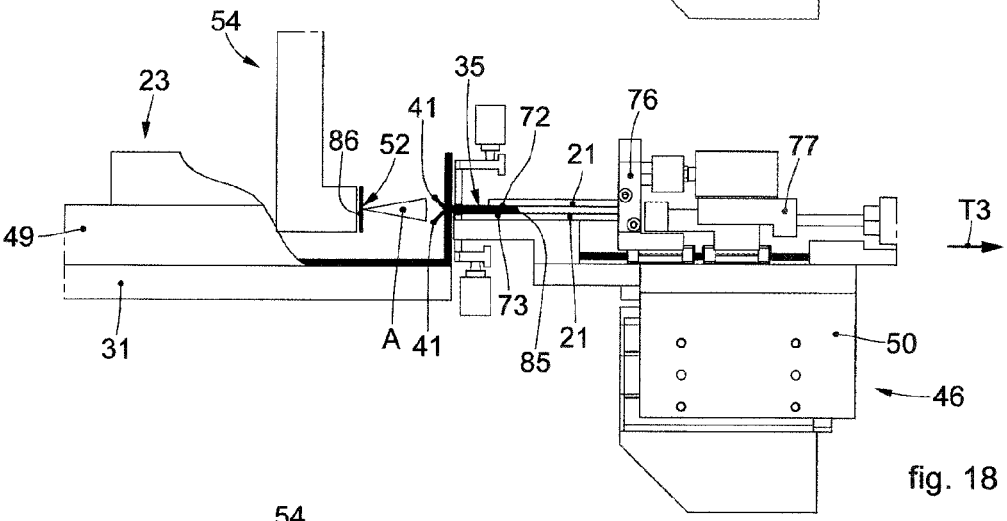

At this point, see FIG. 18, the small blades 72 and 73 with corresponding supports 21 are retracted in direction T3 so as to leave at least the flaps 41 of the strip-like element 35 inside the box-like element 23. The abutment element 85 allows to maintain the positioning of the strip-like element during the retraction in direction T3 of the small blades 72 and 73.

Figure 19:
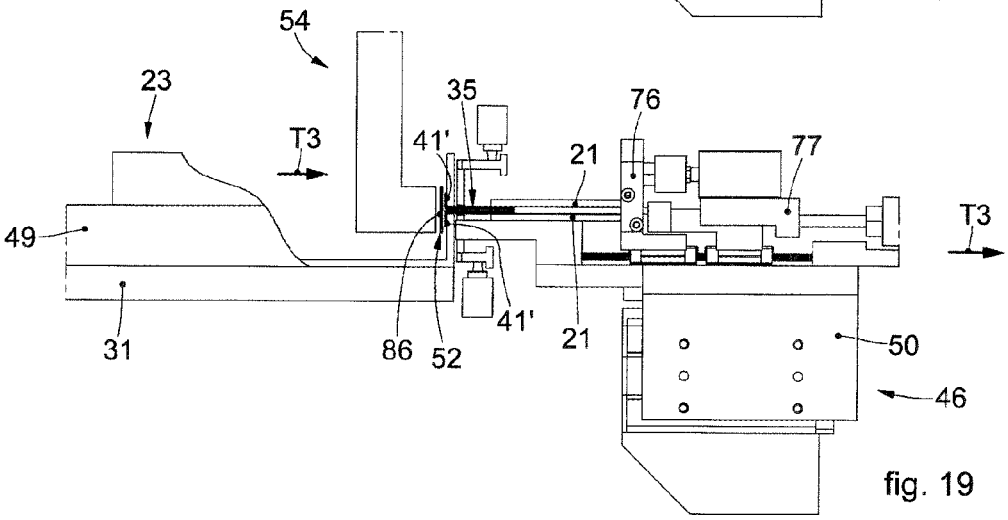

A stream of air A is delivered from the mouth 86 of the arm 54, which passes through the through hole 53 of the adhesive label 52 and hits the flaps 41, causing them to open so as to spread apart and allow the correct application of the adhesive label 52 by translating the arm 54 in direction T3, see FIG. 19.

The adhesive label 52 is then glued to the internal side of the wall 25' or 29', so that it retains the portions 41' of the flaps 41 of the strip-like element 35, which lie on the internal side of the wall 25' or 29', of the box-like element 23, or 24.

The at least temporary attachment of the strip-like element 35 on the box-like element 23 or 24 is therefore complete, and the folding and insertion unit 46 can be moved away and lowered with respect to the rotatable table 31, to be ready for another work cycle on another box-like element 23 or 24.

Figure 6:
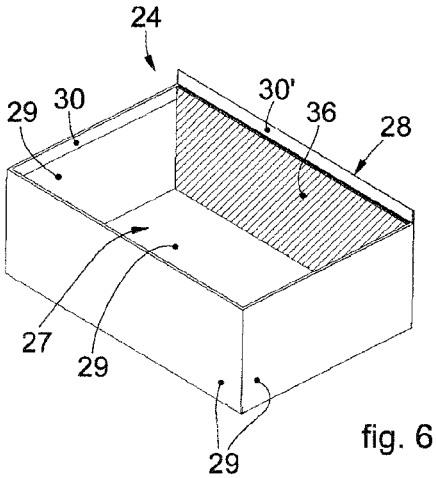
FIG. 6 is another three-dimensional view of the box-like element of FIG. 4 after another work phase.

The box-like element 23, 24 with strip-like element 35 applied and with corresponding label 52 can be taken by the rotatable table 31, by means of another rotation R, to the gluing apparatus 34, where the sheet 36 is applied on the internal side of the wall 25' or 29' where the strip-like element 35 has been applied, see FIG. 6 for example.

The application of the sheet 36 can be achieved, for example, by gluing and, therefore, downstream of the gluing apparatus 34, the pressing apparatus 37 is provided, able to suitably press and attach the cardboard sheet 36 inside the wall 25' or 29'. The box-like element 23, or 24, by another rotation R of the rotatable table 31, is taken into correspondence with the other pressing apparatus 37.

Subsequently, if the box-like element is of the type with a raised flap 30', therefore like the box-like element 24, the folding apparatus 38 is provided in which the flap 30' is folded and tucked toward the inside of the wall 25' or 29' of the box-like element 23 or 24, on which the strip-like element 35 has been applied.

As already mentioned, the rotatable table 31 could be replaced, for example, by an in-line transfer device, for example a conveyor belt, suitable to take the box-like element 23, 24 being worked from the loading apparatus 87 to the extraction apparatus 39, through one or more apparatuses 22, 34, 37, 38 as described, which, in this case, could be located aligned on, for example, one side of the in-line transfer device.

It is clear that modifications and/or additions of parts may be made to the machine and method to work a box-like element as described heretofore, without departing from the field of the present invention.

It is also clear that, although the present invention has been described with reference to some specific examples, a person of skill in the art shall certainly be able to achieve many other equivalent forms of, having the characteristics as set forth in the claims and hence all coming within the field of protection defined thereby.

In the following claims, the sole purpose of the references in brackets is to facilitate reading: they must not be considered as restrictive factors with regard to the field of protection claimed in the specific claims.

The invention claimed is:

1. Machine to work a box-like element (23, 24), wherein it comprises at least a work apparatus (22) provided with: at least a cutting unit (43) to cut at least a strip-like element (35) positioned on a corresponding lying plane (G) in a first substantially plane configuration; at least a loading unit (45) provided with at least a thrust blade (70) translatable in a first direction (T3); at least a folding and insertion unit (46) provided with a housing seating (84) of the strip-like element (35), said housing seating (84) being directed substantially in an orthogonal direction with respect to said lying plane (G) of the strip-like element (35) in said first substantially plane configuration, so that following the translation of the thrust blade (70) in said first direction (T3) the strip-like element (35) is introduced into said housing seating (84), assumes a substantial "U" shape and has at least a pair of flaps (41) and at least a connection part (42), said folding and insertion unit (46) being translatable in a second direction (T4) toward the box-like element (23, 24) so as to at least partly insert said pair of flaps (41) in a slit (26) made in the box-like element (23, 24); and at least an attachment unit (51) of part of said flaps (41) of the strip-like element (35) inside said box-like element (23, 24) on which the slit (26) is made, so that at least the connection part (42) protrudes from the box-like element (23, 24).

2. Work machine as in claim 1, wherein said first direction of translation (T3) of said loading unit (45) is substantially orthogonal to the lying plane (G) of the strip-like element (35) and substantially aligned with said housing seating (84).

3. Work machine as in claim 1, wherein said housing seating (84) has a thickness (S) substantially equal to the sum of the thickness of the flaps (41) of the strip-like element (35) and of the thrust blade (70).

4. Work machine as in claim 1, wherein said housing seating (84) is defined by at least a pair of small blades (72, 73) between which said strip-like element (35) is inserted.

5. Work machine as in claim 1, wherein said housing seating (84) comprises at least an abutment element (85) for said connection part (42).

6. Work machine as in claim 1, wherein said attachment unit (51) comprises at least an arm (54) configured to remove at least one adhesive label (52) from a strip (60) of adhesive labels and apply it to said flaps (41) of the strip-like element (35).

7. Work machine as in claim 6, wherein said arm (54) comprises at least a mouth (86) configured to suck in or blow air and suitable to retain said adhesive label (52) or allow to send a stream of air (A) toward said flaps (41) of the strip-like element (35) so that they suitably spread apart, said adhesive label (52) being provided with a through hole (53) for the passage of said stream of air (A) from the arm (54).

8. Work machine as in claim 1, wherein it comprises a gluing apparatus (34) located downstream of said work apparatus (22) and configured to apply at least one sheet (36) of paper, cardboard or other material, to the inside of a wall (25', 29') of said box-like element (23, 24) where the flaps (41) of the strip-like element (35) are attached.

9. Work machine as in claim 1, wherein it comprises a rotatable table (31), said rotatable table (31) being configured to rotate intermittently and take said box-like element (23, 24) from a loading apparatus (87) to at least said work apparatus (22) and then to at least an extraction apparatus (39) of the box-like element (23, 24).

10. Method to work a box-like element, using a work machine as in claim 1, wherein it comprises: cutting to size a strip-like element (35); folding said strip-like element (35) cut to size so as to obtain therefrom a substantially U-shaped conformation; inserting two flaps (41) of said strip-like element (35) folded substantially U-shaped inside a slit (26) made on a box-like element (23, 24), so that at least part of said two flaps (41) is protruding inside the box-like element (23, 24) and a connection part (42) of said folded strip-like element (35) is protruding from said slit (26); attaching said protruding flaps (41) inside said box-like element (23, 24).

* * * * *